US010104979B2

(12) United States Patent
Bethel et al.

(10) Patent No.: US 10,104,979 B2
(45) Date of Patent: Oct. 23, 2018

(54) INFLATABLE BED MATTRESS LIFTS

(71) Applicant: Disney Enterprises, Inc., Burbank, CA (US)

(72) Inventors: Jeffrey Todd Bethel, Clermont, FL (US); Trevor James Larsen, Winter Garden, FL (US); Jeffrey Norman Vahle, Windermere, FL (US)

(73) Assignee: Disney Enterprises, Inc., Burbank, CA (US)

( * ) Notice: Subject to any disclaimer, the term of this patent is extended or adjusted under 35 U.S.C. 154(b) by 255 days.

(21) Appl. No.: 14/843,639

(22) Filed: Sep. 2, 2015

(65) Prior Publication Data

US 2015/0374134 A1 Dec. 31, 2015

Related U.S. Application Data

(63) Continuation-in-part of application No. 13/561,132, filed on Jul. 30, 2012.

(51) Int. Cl.
*A47C 19/04* (2006.01)
*A47C 21/02* (2006.01)

(52) U.S. Cl.
CPC ..... *A47C 19/045* (2013.01); *A47C 21/028* (2013.01)

(58) Field of Classification Search
CPC ..... A47C 21/028; A47C 19/045; A47C 21/06; A47C 19/04; A61G 7/1021; A61G 7/05769; A61G 13/1265; A61G 13/1285
USPC ..... 5/412, 644, 654, 655.3, 658, 659
See application file for complete search history.

(56) References Cited

U.S. PATENT DOCUMENTS

| | | | | |
|---|---|---|---|---|
| 5,257,430 | A * | 11/1993 | Yamaguchi | A47C 19/045 254/93 HP |
| 5,313,679 | A * | 5/1994 | Yamaguchi | A47C 19/045 254/93 HP |
| 6,317,909 | B1 * | 11/2001 | Blum | A61G 5/14 297/DIG. 10 |
| 8,246,706 | B2 | 8/2012 | Scarleski | |
| 8,510,880 | B2 | 8/2013 | Scarleski | |
| 8,549,681 | B2 | 10/2013 | Scarleski | |
| 8,863,326 | B2 | 10/2014 | Scarleski | |
| 2004/0133978 | A1 * | 7/2004 | Fairchild | A47C 21/028 5/488 |
| 2009/0083909 | A1 * | 4/2009 | Amsler, Jr. | A47C 19/045 5/660 |
| 2012/0260432 | A1 | 10/2012 | Scarleski | |
| 2013/0232698 | A1 * | 9/2013 | Ward | A47C 21/00 5/659 |

* cited by examiner

*Primary Examiner* — Eric J Kurilla
(74) *Attorney, Agent, or Firm* — Ference & Associates LLC

(57) ABSTRACT

An embodiment provides an inflatable bed mattress lift. In an embodiment, six extensions extend from a central portion and may be inflated to provide predetermined tuck points for securing bedding material to the bed mattress. The inflatable bed mattress lift and extensions thereof may be of a size to match a predetermined mattress size. The inflatable bed mattress lift may include more than six extensions, e.g., eight extensions. The extensions may be shaped or angled at terminal ends to match a rectangular dimension of an overlying bed mattress. Other aspects are described and claimed.

18 Claims, 6 Drawing Sheets

INFLATABLE BED MATTRESS LIFTS

CROSS REFERENCE TO RELATED APPLICATIONS

This application is a continuation-in-part of U.S. patent application Ser. No. 13/561,132, filed on Jul. 30, 2012, the content of which is incorporated by reference herein.

BACKGROUND

Lifting or elevating a mattress can be challenging. The challenge is magnified in certain settings such as in a hotel, a resort, on a cruise ship, etc., as housekeeping employees may need to turn around many rooms in short order, including changing sheets on many beds (for example, over 35 per day). Moreover, the lifts per room are many, as in a typical process housekeeping employees repeatedly lift the bed mattress to tuck the sheets between the mattress and box spring, e.g., three sides for each bed, each working day. With little time to spare, housekeeping employees want to perform such lifts, in addition to other duties, quickly and efficiently.

BRIEF SUMMARY

In summary, one aspect includes an inflatable bed mattress lift, comprising: an inflatable component; and a connection element for fluid entry and exit from the inflatable component; the inflatable component comprising: a central area; and six extensions extending from the central area; wherein at least one of the six extensions includes the connection element; wherein the six extensions extend from the central area in pairs; and wherein each pair extends from opposite sides of the central area along a unique axis.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1B:
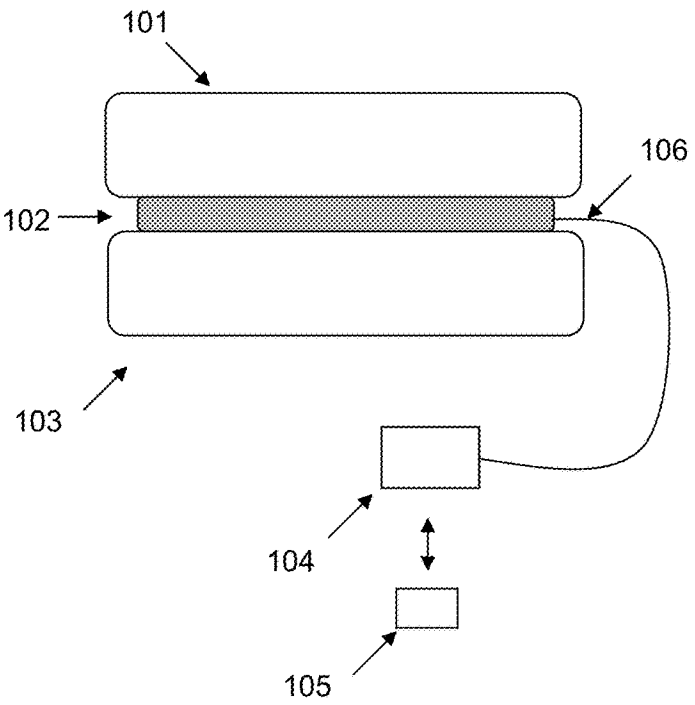
FIG. 1(A-B) illustrates side views of an example bed lift system.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, appearances of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of claimed embodiments. One skilled in the relevant art will recognize, however, that the various described embodiments can be practiced without one or more of the specific details, or with other methods, components, materials, et cetera. In other instances, well-known structures, materials, or operations are not shown or described in detail. The following description is intended only by way of example, and simply illustrates certain example embodiments.

Conventional rigid bed lifts, such as rigid lifting devices for mechanically lifting a mattress and thus separating it from an underlying bedding component, such as a box spring, have significant drawbacks. Such devices require manual manipulation by the user and often require a complex array of parts. Such devices do not significantly reduce the manual involvement of the user in making the lift. Therefore, the lifting remains problematic, as best appreciated by considering certain situations such as in a hotel or resort where repeated lifts of even reduced magnitude contribute significantly to housekeeping employee fatigue. Moreover, complex mechanical contraptions heretofore proposed tend to be overly expensive and complex, thus counseling against their adoption.

In addition, although certain inflatable mattress lifts have been proposed and developed, each does not take into consideration that the shape of the inflatable mattress lift impacts its cost and its ability to function properly. For example, conventional inflatable mattress lifts are not shaped with lift or tuck points for bedding material in mind (e.g., tuck points for securing sheets, covers, etc.). Rather, conventional inflatable mattress lifts are either over-sized, such that an entire periphery of the mattress is elevated, or are provided in a shape that does not take into account that only certain, particular areas of the periphery of the mattress need to be elevated. An over-sized inflatable mattress lift takes a longer time to inflate and wastes material used for its over-sized construction. Shaped inflatable mattress lifts conventionally avoid these difficulties, but nonetheless are not specifically shaped in order to lift only the areas of the mattress periphery necessary for changing bedding material, i.e., specific tuck points. If more or fewer tuck points are lifted, precision of securing sheets and bed covering suffers, which impacts the quality of the turn over service. This may be particularly noticeable when inexperienced housekeeping employees attempt to make up a bed without knowing the precise location of the tuck points.

An embodiment addresses these and other shortcomings of conventional approaches by providing an inflatable bed mattress lift that reduces the material requirements and wait times by implementing a shaped bed mattress lift. Moreover, an embodiment is shaped with particular attention to assisting the housekeeping employee in achieving precision in the bed making task. Thus, an embodiment is shaped such that it elevates predetermined tuck points of the bed mattress, minimizes housekeeping employee manual involvement in the lift to essentially nothing and guiding the housekeeping employee as to the precise location where tucks should be made. As will become more apparent by review of the example embodiments illustrated in the figures, the various embodiment provide efficient, cost effective inflatable mattress lifts for lifting bed mattresses easily and in a repeatable way.

Referring to FIG. 1(A-B), side views of an example bed lift system are illustrated. A first bedding component 101, such as a mattress and a second bedding component 103, such as a box spring, have disposed there-between a third component comprising an inflatable bladder 102. The inflatable bladder 102 may be inflated by provisioning a fluid (liquid or gas, for example air) thereto via a fluid pump 104, as connected to inflatable bladder 102 via a suitable line 106. The fluid pump 104 in turn may be actuated by a remote mechanism, such as via operation of a remote control device 105.

Figure 1A:
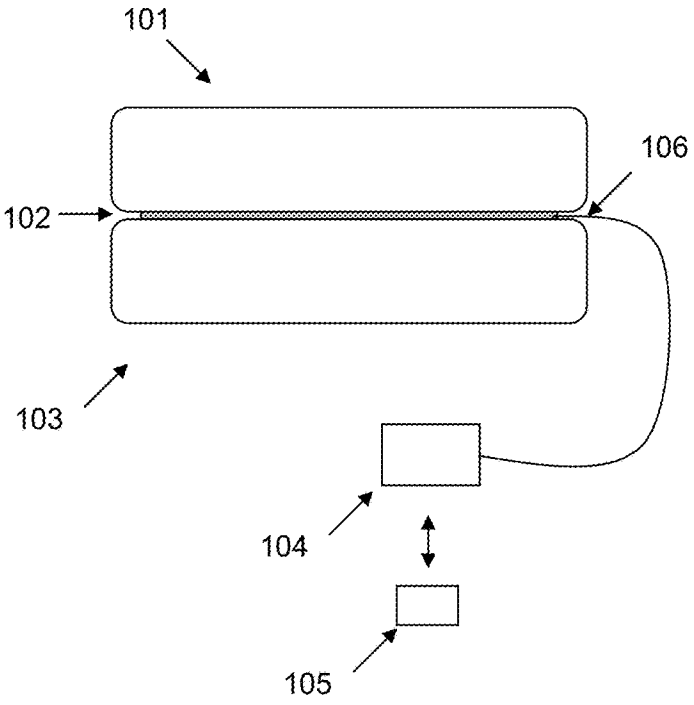

In a non-inflated configuration, FIG. 1A, the inflatable bladder 102 does not disrupt the first bedding component 101 or the second bedding component 103. As such, the inflatable bladder 102 may be left in place in the non-inflated condition without disturbing the normal bedding configuration. In one example, the inflatable bladder 102 may reside 10 or 12 inches inside of the perimeter of the bedding components (mattress/box spring). In an inflated configuration, FIG. 1B, the inflatable bladder 102 inflates or fills with fluid, as for example provided via the fluid pump 104. Responsive to inflation, the inflatable bladder 102 expands commensurate with the increased volume of fluid therein. This expansion in turn provides a configuration in which the first bedding component 101, such as a mattress, lifts or separates with respect to the second bedding component 103, such as a box spring. In such an inflated configuration, FIG. 1B, the underside of the first bedding component 101, such as a mattress, is partially exposed, allowing a housekeeping employee to readily change bedding material, such as a fitted sheet (not shown) or when changing flat (non-fitted) sheets.

The inflatable bladder component 102 may be formed of a flexible/stretchable material such as rubber or other elastic or synthetic type material such that, responsive to fluid being provided under pressure via fluid pump 104, the inflatable bladder 102 expands in a similar fashion to a balloon. Alternatively or additionally, the inflatable bladder 102 may be less elastic or non-elastic, as compared to a material such as rubber or other comparable elastic or synthetic material. In such an embodiment, the inflatable bladder 102 may achieve expansion or inflation via filling without stretching to an appreciable degree, as for example in the fashion that a fire hose lies flat until filled with pressurized water, and changes shape or inflates under pressure.

Figure 2B:
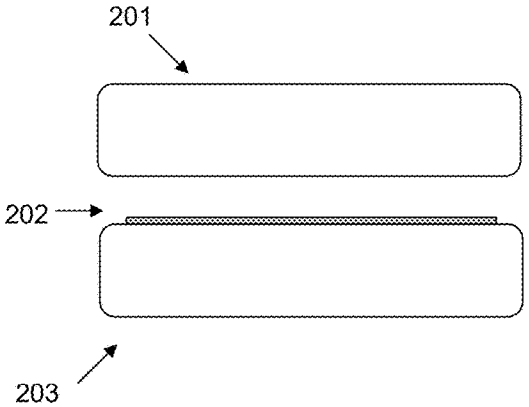
FIG. 2(A-C) illustrates exploded side views of example bed lift systems.
Figure 2A:
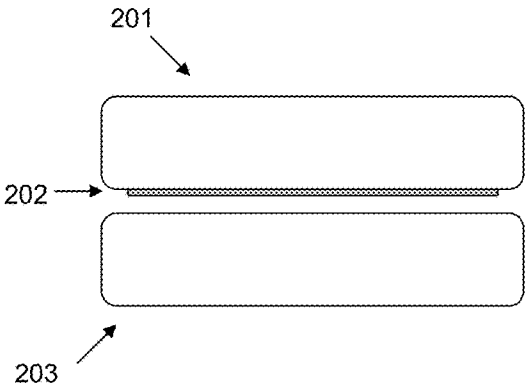
Figure 2C:
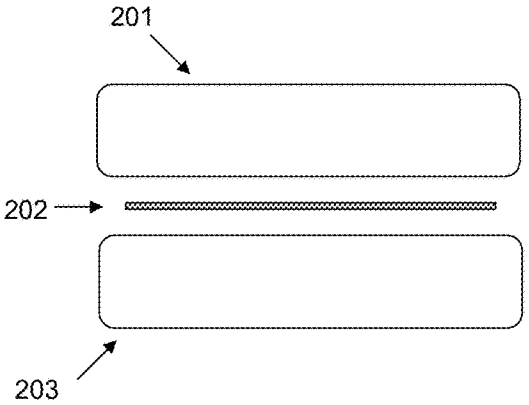

The inflatable bladder component 202 may be integrated into the first bedding component 201, such as integrated into a mattress on one or both sides, as illustrated in FIG. 2A. The inflatable bladder component 202 may additionally or alternatively be integrated into the second bedding component 203, such as integrated into a box spring on a side that interfaces with a mattress, as illustrated in FIG. 2B. Alternatively or additionally the inflatable bladder component 202 may be provided as a separate, stand alone component that is placed in between the first bedding component 201 and the second bedding component 203, as illustrated in FIG. 2C.

The inflatable bladder component 202 may be integrated into one or more of the bedding components 201, 203 in a variety of ways. During manufacture, the inflatable bladder component 202 may be adhered to one or both of the bedding components 201, 203. Such integration may be provided for example via a permanent bonding process using an adhesive, or permanent fastener, or via provisioning of a reversible attachment means, for example snaps, VELCRO portions, etc. Mating portions would thus be provided on each of the inflatable bladder 202 and the first bedding component 201 or the second bedding component 203, in a suitable combination. Staples, for example, in an internal or border portion or component of the inflatable bladder 202 not to be filled with fluid, or ties or like fasteners, may be utilized. Moreover, a hybrid embodiment that balances integration with stand alone bladder capabilities may be provided, such as via fashioning a holding sleeve or like pocket for inclusion of a separate inflatable bladder portion 202 within one or both of the first bedding component 201 and the second bedding component 203. It is also contemplated that bladder portion 202 may be fitted underneath a fabric covering of bedding component 201 or 203 so long as the fabric covering has sufficient ability to be distorted from flat so that it allows the bladder portion to be inflated sufficiently for a particular application. Likewise fluid pump 104 could be positioned within a hollow portion of a bedding component 103 (e.g., in a hollow box spring). In this manner a box spring or mattress would appear to be conventional upon visual inspection as the devices implementing the present invention would be hidden from view. Alternatively, a stand alone inflatable bladder 202 may be provided and simply fitted between bedding components 201, 203, as illustrated in FIG. 2C.

The fluid pump 104 may take a variety of configurations. A fluid pump 104 as described herein takes the meaning of a device that provides pressurized fluid (liquid or gas) to the inflatable bladder in response to actuation. An example fluid pump 104 is an electric motor powered air pump. Another example of a fluid pump is a reservoir of compressed air. Fluid pump 104 may be provided or integrated with either bedding component 101/103, or provided as a separate unit, or integrated with a separate device such as a hospitality cart, vacuum cleaner, fan, or other available source that can be adapted to provide a flow of pressurized fluid. It is further contemplated that fluid pump 104 may be provided remotely and centralized to support multiple bladders 102 in different rooms with pressurized fluid being ported into individual rooms from the centralized source. This might be practical, for example, in a hospital or similar facility where pressurized gasses are already ported to individual rooms and beds.

Suitable means for actuating the fluid pump 104 include but are not limited to the following. A fluid pump 104 may be actuated via a manual switch or a control valve. A fluid pump 104 may be actuated via a remote control device 105. In the case of a remote control device, a fluid pump 104 may be actuated by a hand held remote control device 105 that can actively or passively provide information to the fluid pump 104 for actuation. The information may be provided to fluid pump 104 for example from a hand held device, e.g., device 105, and may be tied to a particular employee or authorized user such that only an authorized user may actuate the fluid pump 104.

Examples of actively providing information to the fluid pump 104 for actuation include but are not limited to transmitting infrared or short-range wireless communication signal(s) to an actuation component of the fluid pump 104. Alternatively, information for actuating the fluid pump 104 may be provided actively through another type of network connection, such as via a wired or wireless network connection to an actuation component of the fluid component. Embodiments may provide centralized control of the system or components thereof via such networked connections. For example a remote signal may be communicated via a network connection to the fluid pump 104, via an actuation component including a processor and memory storing program instructions for pump actuation, which on receipt, causes the fluid pump to actuate or cease operation.

Examples of passively providing actuation information to a fluid pump 104 include but are not limited to providing information, such as a bar code, that can be read by a scanning component in communication with a fluid pump 104. Alternatively, an RFID reader may be provided that is in communication with the fluid pump 104, where an RFID device presented to the RFID reader causes actuation of a fluid pump 104.

For its part, the inflatable bladder may take on a variety of configurations, non-limiting (top plan view) examples of which are illustrated in FIG. 3(A-D). In one example embodiment, illustrated in FIG. 3A, an inflatable bladder 302A may be formed of a unitary body with inflatable portion(s) or sub-component(s). The example illustrated in FIG. 3A shows a unitary body 302A in which a generally "U" shaped inflatable sub-component is provided. The "U" shaped inflatable sub-component may take a variety of shapes, including an "O", an "X" or other shapes that require less volume to lift the mattress than a continuous bladder. The inflatable sub-component may be fashioned from the same or different material as that used for the non-inflatable portion, that is, the portion in the middle region of the unitary body 302A.

The inflatable portion may be formed via pressing or bonding the unitary body 302A such that fluid (gas or liquid) may only enter the inflatable portion of the unitary body 302A (via an appropriate valve or fitting) and be prevented from entering the non-inflatable portion, such that the inflatable portion is cordoned off from and not in fluid communication with the non-inflatable portion. This arrangement has the advantage of requiring less fluid volume (less than a bladder that does not include non-inflatable portion(s)) to achieve appreciable inflation of the inflatable bladder 302A.

Figure 3A:
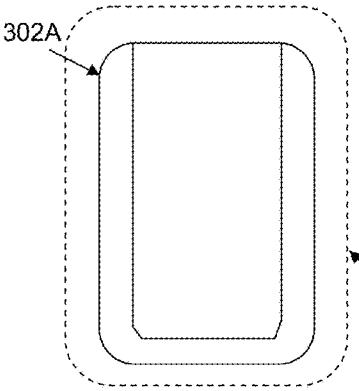
FIG. 3(A-D) illustrates top plan views of example inflatable bladders.
Figure 3B:
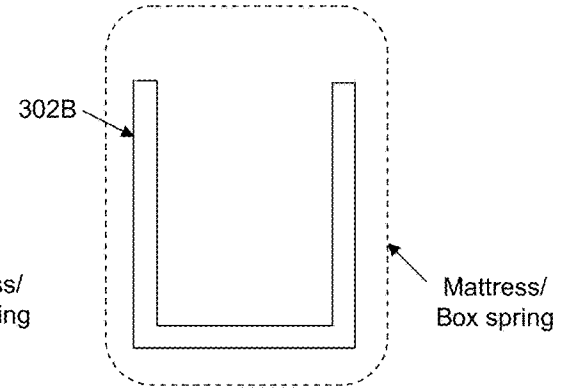
Figure 3C:
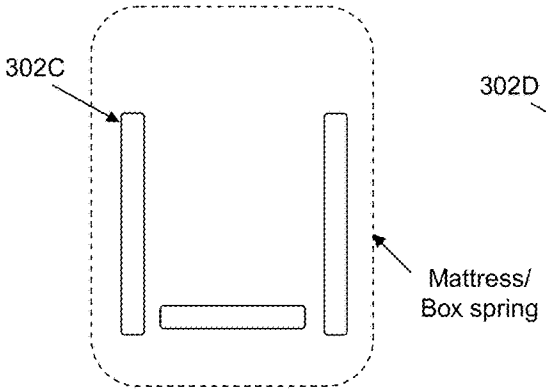
Figure 3D:
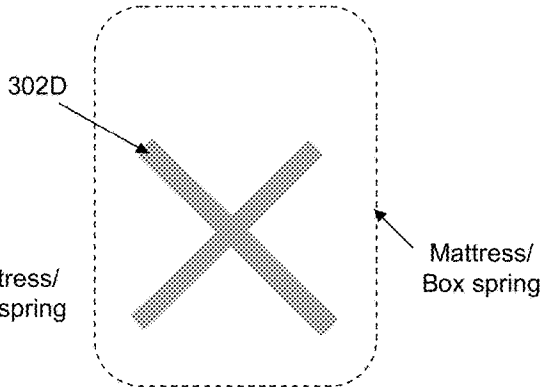

In an alternative embodiment, the inflatable bladder (302B-302D) may take the form of a unitary body without sub-components or portions that are non-inflatable, as illustrated in FIG. 3B-D. In FIG. 3B, an example inflatable bladder 302B is formed of a single component that is inflatable and has a generally "U" shaped configuration. The example inflatable bladder 302D illustrated in FIG. 3D likewise takes the form of a unitary inflatable body that has a generally "X" shaped configuration. Alternatively, the inflatable bladder 302C may be formed from a plurality of separate components, as illustrated in FIG. 3C. Thus, the inflatable bladder 302C can be formed from two or more separate components, if desired. Furthermore, the separate components may be connected to one another, either with or without a means of fluid communication there-between.

Figure 4:
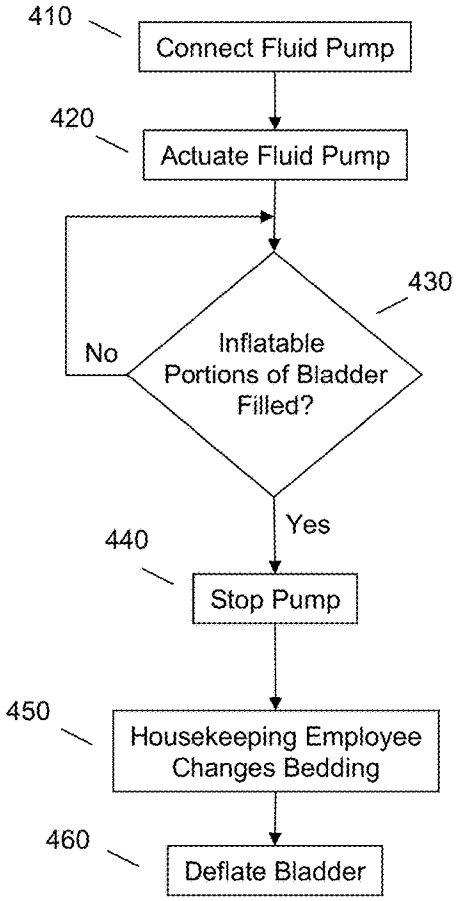
FIG. 4 illustrates an example method.

In an example method, illustrated in FIG. 4, a suitable fluid pump is connected to an inflatable bladder 410. The connection can be made ahead of time, such as for example via integration of the fluid pump with one or more other system components, such as via inclusion of an integrated fluid pump in a box spring with an inflatable bladder at the time of manufacture. Alternatively, a separate fluid pump, such as carried on a housekeeping cart or provided via a vacuum cleaner attachment, may be attached to a fitting of an inflatable bladder just prior to each use. In any event, a connection is made between a suitable fluid pump and an inflatable bladder.

Next, a user will actuate the fluid pump such that the fluid pump may provide fluid to inflate the bladder 420. As described herein, the fluid pump may be actuated in a variety of ways. For example, if a compressed air cartridge is used, a simple release of a valve or connection of a compressed air cartridge may actuate the fluid pump. Likewise, a manual switch may be provided on the fluid pump, such as a switch to actuate an electric motor that pumps fluid into the inflatable bladder. Furthermore, other actuation means may be employed, such as for example use of a remote control, use of a bar code and bar code reader, an RFID arrangement, a centralized actuation over a network connection, or the like. In any event, a fluid pump is actuated to provide fluid to the inflatable bladder for inflation.

Once the inflatable bladder is filled to an acceptable amount, 430, the fluid pump may be stopped 440. By this it is meant only that additional fluid is no longer required, although the fluid pump may continue to be on or operable, for example operating to maintain an acceptable pressure. Alternatively, if a one way or reversible fitting/valve is employed, the fluid pump may be literally stopped and shut off, as the fluid will be prevented from reversing its course (that is, the fluid will not be able to escape from the inflatable bladder without further action). The fluid flow into the bladder component or components also may be stopped automatically, for example via use of a pressure sensitive or timing device.

With adequate separation of bedding components, such as between a mattress and underlying box spring, a housekeeping employee is better able to change the bedding 450. Once this task has been accomplished, the inflatable bladder may be deflated 460. The deflation of the inflatable bladder may be accomplished in a variety of ways, such as via releasing a valve or fitting and allowing the elasticity of the bladder to act to expel the fluid, releasing a valve or fitting and allowing the weight of the bedding component (mattress) to expel the fluid, or even actuation of a fluid pump (or a separate fluid pump) to actively expel the fluid. The release of the fluid may be actuated through a suitable control arrangement, for example a remote control, a bar code reader, an RFID arrangement, etc., and may even be a timed release (for example, automatically deflating after 5-10 minutes).

Figure 5:
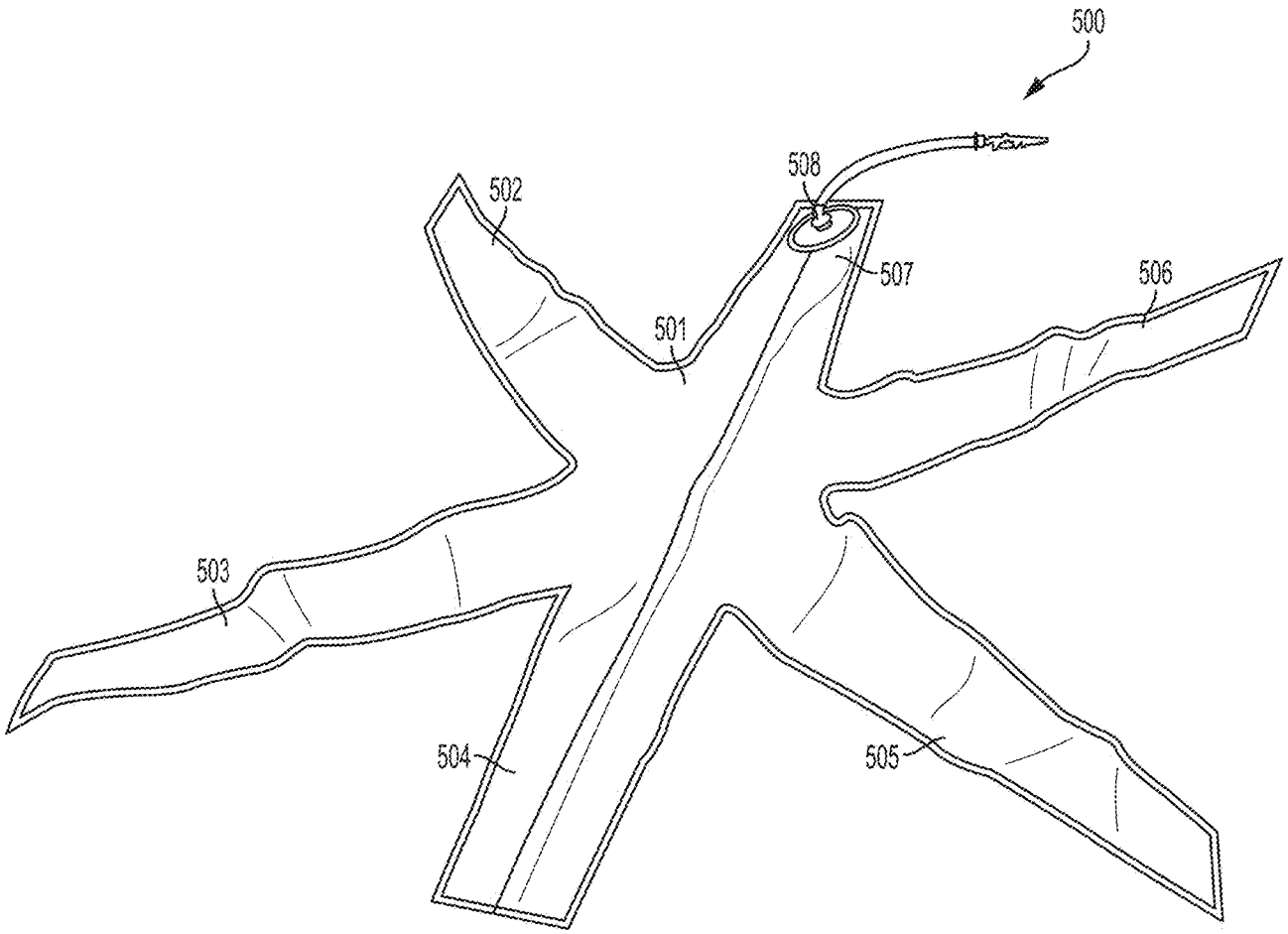
FIG. 5 illustrates an example inflatable bed mattress lift having six extensions.

Referring to FIG. 5, an example of an inflatable bed mattress 500 lift having six extensions 502-507 is illustrated. The inflatable bed mattress lift 500 includes a central area 501 that may be in fluid communication with the extensions 502-507 such that one connection 508 to a fluid source, e.g., compressed air, an air pump, etc., may be utilized to fill the central area 501 and all of the extensions 502-507.

In the embodiment illustrated in FIG. 5, the six extensions 502-507 are specifically spaced to provide lifting to particular areas of the bed mattress when the inflatable bed mattress lift 500 is placed between the bed mattress and an underlying component, e.g., box spring or other firm layer. In the example illustrated in FIG. 5, the six extensions 502-507 are specifically spaced to provide lift to a bed mattress at predefined tuck points. As may be appreciated from the illustration of FIG. 5, as well as the description provided herein, the inflatable mattress lift 500 including extensions 502-507 at the positions shown, provides three tuck points per side of a bed mattress, with four of the tuck points being located at the corners of the bed mattress.

Specifically, extensions 502, 503, 505 and 506 are positioned at the corners of the bed mattress. Extensions 503-505 lie under one long side of the bed mattress, whereas extensions 502, 507 and 506 lie along another long side of the bed mattress. The width dimension of the bed mattress overly the dimension defined by the span between extensions 502-503, 504-507 and 505-506. Thus, it may be appreciated that when the inflatable bed mattress lift 500 is positioned between a bed mattress and box spring, it may be inflated by entrance of fluid into the connection 508 and by operation of expansion of the central portion 501 and the extensions 502-507, and thus six tuck points are provided to the housekeeping employee for changing the bed linens. Once this task is complete, the fluid may be evacuated from the inflatable bed mattress lift 500, either passively or via active pumping.

As illustrated in FIG. 5, the six extensions 502-507 are provided at particular angles with respect to the central area 501 such that when aligned with a mattress, these extensions 502-507 match predetermined tuck points that will be used by the housekeeping employees. In the example of FIG. 5, the extensions 502-507 extend from the central area 501 in pairs, with each pair falling along a unique axis. The specific example of FIG. 5 illustrates that the extension pair of 502 and 505 has a unique axis that is spaced from the extension pair of 504 and 507 by about 45 degrees. The unique axis of extension pair of 502 and 505 is spaced from the unique axis of extension pair of 503 and 506 by about 60 degrees. Thus, each extension pair lies along a unique axis that is separated by at least 45 degrees from a next closest unique axis, with some extension pairs being spaced about 60 degrees from their neighboring pair's axis.

It may also be appreciated that the ends of the extensions 502-507 are themselves specifically shaped in order to achieve material efficiency and maximum functionality given the dimensions of the overlying mattress. The example of FIG. 5 illustrates that extensions 502, 503, 505 and 506 terminate in an angled shape, whereas extensions 504 and 507 terminate in a rectangular shape. Moreover, the choice of shape for the terminal edges of the extensions 502-507 is specifically designed to correspond to the rectangular shape of the overlying bed mattress. In other words, the coordination of the shapes for the ends of extensions 502-507 ensures that the outer periphery of the inflatable bed mattress lift 500 aligns with the outer periphery of a bed mattress. In an embodiment, the length of the extensions may be chosen to match a specific bed mattress, e.g., a twin size bed mattress, a queen size bed mattress, a king size bed mattress or a California king size bed mattress. As will be appreciated by those having ordinary skill in the art, the lengths of the extensions 502-507 may be varied according to the type of bed mattress with which the inflatable bed mattress 500 is used. Moreover, the length of the extensions 502-507 may be adjusted such that the terminal edges define a smaller or lager rectangle than the overlying bed mattress's periphery.

In FIG. 5 it is illustrated that the lengths of the extension pairs is not uniform. For example, extension pair 502-505 and extension pair 503-506 are longer in length than extension pair 504-507. This corresponds to an alignment of the inflatable bed mattress lift 500 such that the extension pair 504-507 traverses across the bed mattress width, with extension pair 502-505 and extension pair 503-506 traversing the diagonal length of the bed mattress.

Figure 6:
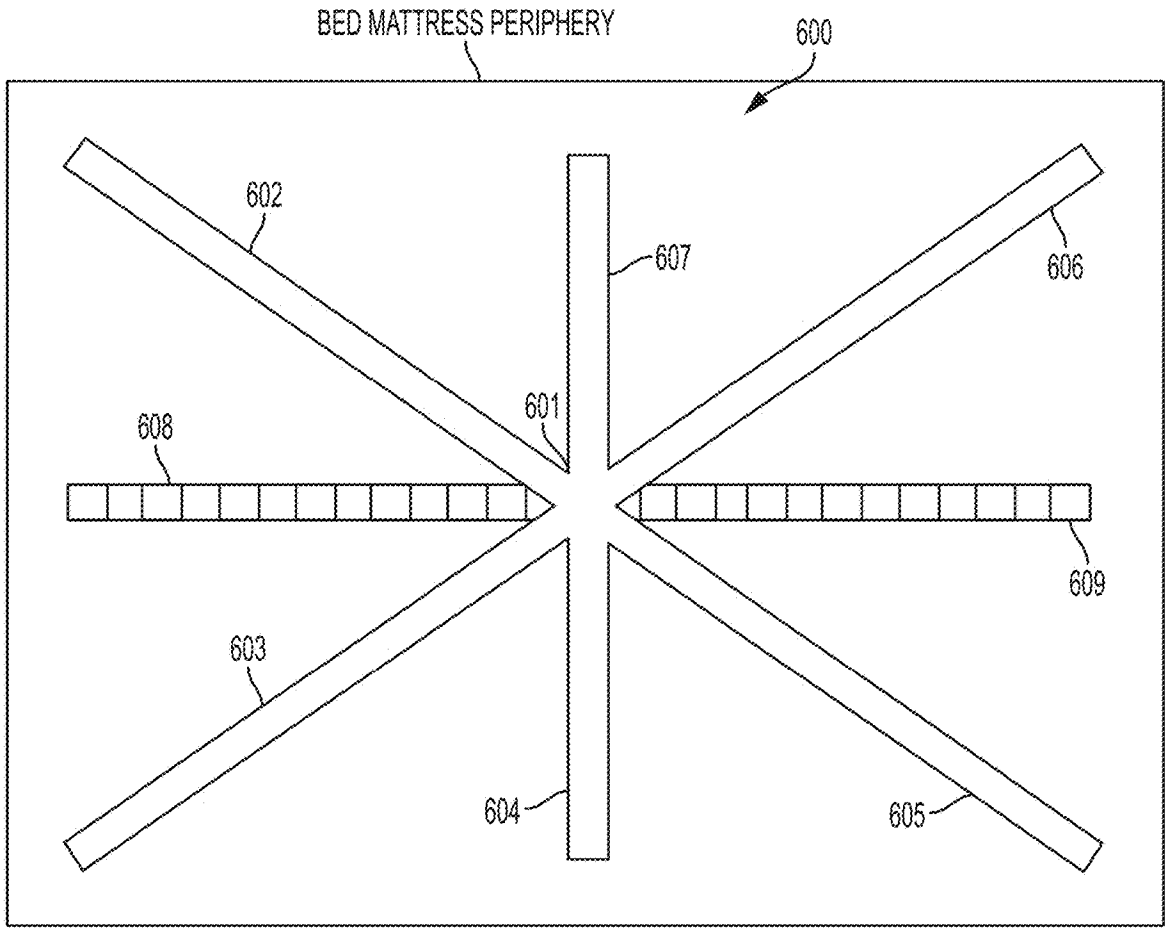
FIG. 6 illustrates an example inflatable bed mattress lift having eight extensions.

In another embodiment, the number of extensions emanating from the central area may be increased in order to provide more tuck points at specific areas of the bed mattress. Such additional tuck points may be desired or required, e.g., for different sized bed mattresses (e.g., larger bed mattresses), for different covering types (e.g., different types of sheets or covers used on the bed mattress), etc. For example, as illustrated in FIG. 6, the inflatable bed mattress lift 600 includes two additional extensions 608 and 609 as compared to the embodiment illustrated in FIG. 5. The additional extensions 608 and 609 join with extensions 602, 603, 604, 605, 606 and 607, and likewise extend from a central area 601. All of the extensions 602-609 may be in fluid communication with the central area 601 such that only one connection with a fluid source is needed (the connection is not specifically illustrated in FIG. 6).

The extensions 602-609 again form pairs, e.g., extensions 608 and 609 form an extension pair sharing a unique axis. The embodiment illustrated in FIG. 6 illustrates that the extensions 602-609 have different spacing as compared with the embodiment illustrated in FIG. 5. The extensions 602-609 are spaced equally from one another, i.e., each extension pair lies along a unique axis, and each unique axis is spaced about 45 degrees from another, neighboring unique axis. This permits formation of eight tuck points when the inflatable bed mattress lift 600 is inflated. The two additional tuck points in this case may be formed at the head and foot of the bed mattress, e.g., in a central position as illustrated in FIG. 6. The extensions may terminate in shaped ends, e.g., similar to those illustrated in FIG. 5, although this is not explicitly illustrated in FIG. 6. For example, additional extensions 608 and 609 may terminate in rectangular edges similar to those illustrated for extensions 504 and 507 of FIG. 5. However, additional extensions 608 and 609 may be formed to have shaped edges. Moreover, additional extensions 608 and 609 may be the same or somewhat longer than extensions 504, 507 of FIG. 5 (proportionally), or may be about equivalent in length to extensions 602, 603, 605 and 606, as they are placed along the length dimension of the bed mattress rather than the width dimension thereof.

As will be apparent to one having ordinary skill in the art, more or fewer extensions may be included in order to provide more or fewer tuck points upon inflation of the inflatable bed mattress lift. Additionally, various extensions may be provided to assist in mattress stability during the lift. For example, an extension projecting near the head of the mattress may not be used as a tuck point, but may nonetheless be provided in order to offer a stable, level lift of the bed mattress during inflation. Thus, the various embodiments described include an improvement to conventional inflatable bed mattress lifts by having specific shapes configured to provide predetermined tuck points upon inflation. This reduces material costs of the inflatable bed mattress lift, saves time as less fluid is needed for inflation of the inflatable bed mattress lift, and predetermines the tuck points for the bedding with respect to the mattress.

From the foregoing it should be understood that embodiments provide a convenient and cost effective way of separating or lifting bedding components such that bedding materials may be quickly and easily changed in a uniform way (i.e., using standard tuck points). The embodiments may be employed to great advantage at least in settings where repetitive lifting of bedding components is necessary and problematic.

This disclosure has been presented for purposes of illustration and description but is not intended to be exhaustive or limiting. Many modifications and variations will be apparent to those of ordinary skill in the art. The embodiments were chosen and described in order to explain principles and practical application, and to enable others of ordinary skill in the art to understand the disclosure for various embodiments with various modifications as are suited to the particular use contemplated.

Although illustrative embodiments have been described herein, it is to be understood that the embodiments are not limited to those precise embodiments, and that various other changes and modifications may be affected therein by one skilled in the art without departing from the scope or spirit of the disclosure.

What is claimed is:

1. An inflatable bed mattress lift, comprising:

an inflatable component; and a connection element for fluid entry and exit from the inflatable component;

the inflatable component comprising:

a central area; and six extensions extending from the central area;

wherein at least one of the six extensions includes the connection element;

wherein the six extensions extend from the central area in pairs;

wherein each pair extends from opposite sides of the central area along a unique axis;

wherein two of the six extensions terminate in a rectangular end; and wherein unique axes of the two of the six extensions terminating in a rectangular end are spaced 45 degrees from immediate neighboring unique axes.

2. The inflatable bed mattress lift of claim 1, wherein each unique axis is spaced 45 degrees from at least one neighboring unique axis.

3. The inflatable bed mattress lift of claim 2, wherein at least two unique axes are spaced 60 degrees from a neighboring unique axis.

4. The inflatable bed mattress lift of claim 1, wherein four extensions of the six extensions terminate in an angled end.

5. The inflatable bed mattress lift of claim 4, wherein the unique axes of the four extensions are spaced 60 degrees from one another.

6. The inflatable bed mattress lift of claim 1, wherein ends of the six extensions align with one another to form a rectangular shape.

7. The inflatable bed mattress lift of claim 6, wherein the rectangular shape is sized to about an outer periphery of a mattress.

8. The inflatable bed mattress lift of claim 7, wherein the rectangular shape is sized to about an outer periphery of a particular mattress size.

9. The inflatable bed mattress lift of claim 1, wherein the two extensions have a shorter length than any other of the six extensions.

10. The inflatable bed mattress lift of claim 1, wherein the inflatable component is substantially rigid.

11. The inflatable bed mattress lift of claim 1, wherein the inflatable component is substantially pliable.

12. The inflatable bed mattress lift of claim 1, wherein the inflatable component is foldable when deflated.

13. The inflatable bed mattress lift of claim 1, wherein the inflatable component further comprises two additional extensions extending from opposite sides of the central area.

14. The inflatable bed mattress lift of claim 13, wherein the two additional extensions extend as a pair along a unique axis from opposite sides of the central area.

15. The inflatable bed mattress lift of claim 14, wherein the unique axis of the two additional extensions is spaced 45 degrees from a nearest neighboring unique axis.

16. The inflatable bed mattress lift of claim 14, wherein the unique axis of the two additional extensions is spaced 90 degrees from at least one other unique axis.

17. The inflatable bed mattress lift of claim 14, wherein the two additional extensions terminate in a rectangular end.

18. The inflatable bed mattress lift of claim 17, wherein the two additional extensions terminate in an angled end.

* * * * *